US005352858A

United States Patent [19]

Keck

[11] Patent Number: 5,352,858

[45] Date of Patent: Oct. 4, 1994

[54] HERMETICALLY SEALED SNAP SWITCH ASSEMBLY WITH PRE-USE BACKFILLING OPTION

[75] Inventor: David W. Keck, Michigan City, Ind.

[73] Assignee: Dwyer Instruments, Inc., Michigan City, Ind.

[21] Appl. No.: 93,767

[22] Filed: Jul. 19, 1993

Related U.S. Application Data

[63] Continuation-in-part of Ser. No. 900,616, Jun. 18, 1992, abandoned.

[30] Foreign Application Priority Data

| | | | |
|---|---|---|---|
| Nov. 30, 1992 | [CA] | Canada | 2084119 |
| Mar. 17, 1993 | [GB] | United Kingdom | 9305540 |
| Apr. 29, 1993 | [DE] | Fed. Rep. of Germany | 4314209 |

[51] Int. Cl.[5] ..... H01H 9/04

[52] U.S. Cl. ..... 200/302.1; 200/306; 200/332

[58] Field of Search ..... 200/302.3, 302.1, 332, 200/332.1, 306

[56] References Cited

U.S. PATENT DOCUMENTS

| | | | |
|---|---|---|---|
| 2,806,114 | 9/1957 | Se Bastian | 200/302.3 |
| 3,431,378 | 3/1969 | Hellman | 200/302.1 |
| 4,434,330 | 2/1984 | Geremia | 200/302.1 |

FOREIGN PATENT DOCUMENTS

| | | | |
|---|---|---|---|
| 598678 | of 0000 | United Kingdom . | |
| 1067693 | 4/1964 | United Kingdom . | |
| 1115533 | 5/1968 | United Kingdom | 200/302.1 |
| 1136160 | 12/1968 | United Kingdom | 200/302.3 |

*Primary Examiner*—Renee S. Luebke
*Attorney, Agent, or Firm*—John M. Mann

[57] ABSTRACT

A hermetically sealed snap switch assembly involving a housing that includes a hermetically sealed snap switch chamber in which a projecting terminal type subminiature snap action switch is mounted in slip fit association with a similar number of depending electrically conductive open ended tubes that are adapted to, prior to use of the switch assembly involved, be respectively hermetically sealed to the switch terminal that is received in same, and be respectively electrically connected in suitable circuitry at the option of the installer, with the arrangement of the assembly being such that optionally a selected one of the depending tubes, prior to such hermetically sealing of same, may be employed for switch chamber purging and backfilling purposes, after which said sealing of same is effected. Also disclosed is a method of backfilling said switch chamber (using such backfilling option) with a switch life enhancing gas.

4 Claims, 2 Drawing Sheets

HERMETICALLY SEALED SNAP SWITCH ASSEMBLY WITH PRE-USE BACKFILLING OPTION

This application is a continuation-in-part of my patent application Ser. No. 07/900,616, filed Jun. 18, 1992 and now abandoned.

This invention relates to switch assemblies that are intended to be installed as part of a complete control for fluid and bulk solid flow or storage systems, and more particularly, to arranging such assemblies for complete hermetic sealing so as to prevent the passage of gas or electrical arcs from within the switch assembly to the exterior of the switch assembly, and to enhance the performance of such a switch assembly as a control in explosive, corrosive, dusty, and damp environments.

Control switch assemblies are commonly used in complete control systems for fluid flow and bulk solid material flow or storage systems that may indicate such important factors as pressure, fluid flow, fluid level, bulk solid material levels, proximity valve positions, etc. However, a major problem with equipment of this type is that it is not fully hermetically sealed even though some sealing may be involved.

The principal object of the present invention is to provide switch assemblies of the general type indicated that are fully hermetically sealed to not only prevent the passage of gases or electrical arcs from within the switch assembly switch mounting chamber, but also provide a control switch of the type indicated that is readily adapted for use in explosive, corrosive, dusty, and damp environments without thereby adversely affecting the operation of the assembly switch.

Another major object of the invention is to provide a switch assembly of the general type indicated in which the switch terminals and the lead wiring connected to same are hermetically sealed for use as such when the switch assembly involved is supplied to the ultimate user.

Yet another object of the invention is to provide a novel housing arrangement for switch assemblies of this type which are arranged to accept subminiature snap action switches of the conventional type that are provided with projecting pin type terminals, by providing the housing switch mounting structure with depending open tubes that are positioned to slidingly receive the respective pin type terminals of the switch so that the respective depending tubes may be thereafter hermetically sealed closed relative to the switch terminal received within same, and lead wire connections made to the respective tubes, which connections are in turn hermetically sealed by being covered with a potting material.

Another important object of this invention is to provide a switch assembly of the type indicated in which the switch itself is enclosed in a hermetically sealed housing that defines over the switch unit involved a dimple or indentation to which external and internal lever arms are fixed for appropriately actuating the switch when a predetermined force acts on the switch assembly external lever to actuate the switch itself through a corresponding movement of the internal lever that is within the hermetically sealed switch chamber defined by the switch housing involved.

Another object of the invention is to provide a method for purging the switch chamber of the housing assembly involved and back filling the hermetically sealed switch chamber involved with gases, such as hydrogen, nitrogen, or helium that enhance the electrical life of the subminiature snap switch involved.

Still another object of the invention is to provide a switch assembly of the type indicated whereby optionally one of the depending tubes, prior to the sealing of same, may be employed for said purging and backfilling purposes, after which said sealing is effected.

In accordance with the present invention, a hermetically sealed snap switch arrangement is provided comprising a housing defined by first and second cupped shaped metallic housing members each defining a substantially planar base wall and an integral side wall that extends about the base wall and from same to a marginal tim portion thereabout, with the side walls of the second housing member extending from said base wall thereof a predetermined fraction of the distance that said side wall of said first housing member extends from said base wall thereof, with the said second housing member being mounted within said first housing member in hermetically sealed relation thereabout, to define the switch mounting chamber of the assembly involved, between said base walls of the respective housing members, with said housing members side walls extending in the same direction, and with said housing second member base wall supporting the switch and including a plurality of depending electrically conductive tubes affixed to same in hermetically sealed relation thereto in which projecting terminals of the switch unit itself are respectively slidingly received in close fitting relation thereto, with the individual housing tubes being hermetically sealed to the switch terminal received in same, with the assembly lead wires being respectively electrically connected to the respective tubes, and including a suitable potting material that covers such connections that the respective lead wires have with the respective tubes; the arrangement is such that optionally one of the individual housing tubes may, prior to said sealing of same, be employed for switch chamber purging and backfilling purposes.

Other objects, uses, and advantages will be obvious or become apparent from a consideration of the following detailed description and the application drawings in which like reference numerals indicate like parts throughout the several views.

IN THE DRAWINGS

Figure 1:
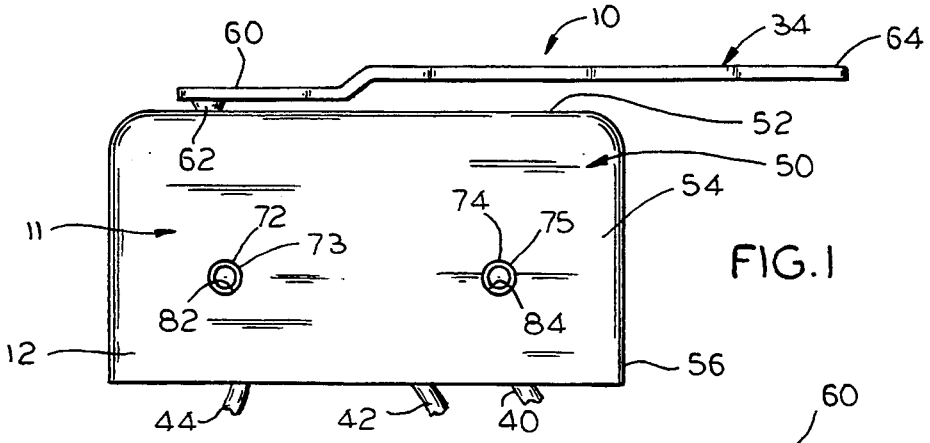
FIG. 1 is side elevational view of a fully hermetically sealed snap switch assembly in accordance with the present invention, from the lower end of which projects the usual lead wires that extend to the electrical components to be controlled by the switch assembly of FIG. 1.
Figure 2:
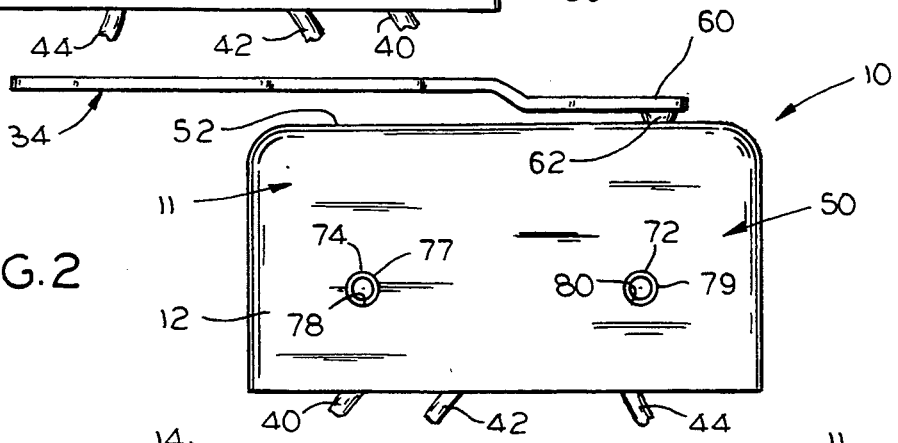
FIG. 2 is a side elevational view of the far side of the switch assembly as shown in FIG. 1.
Figure 3:
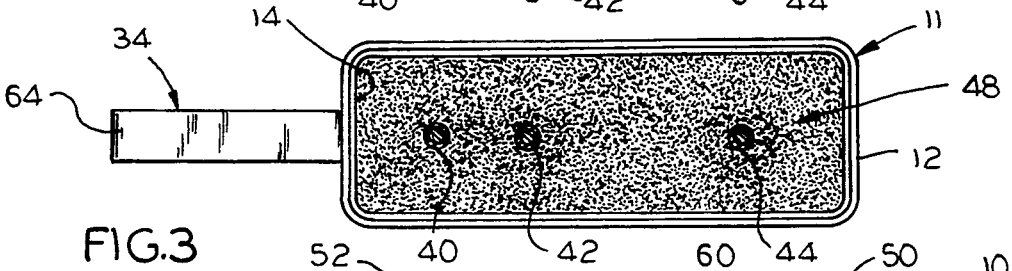
FIG. 3 is a bottom plan view of the switch assembly shown in FIGS. 1 and 2.
Figure 4:
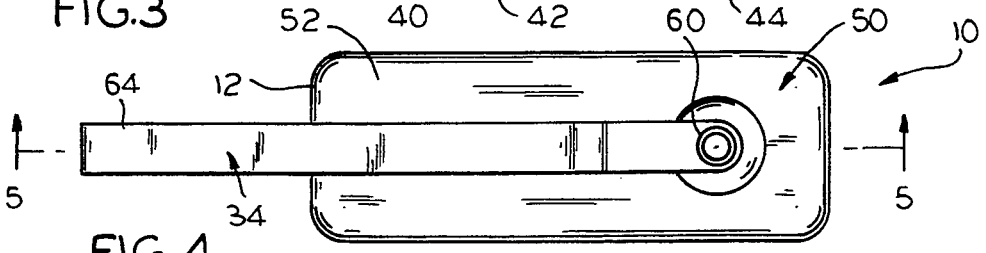
FIG. 4 is a top plan view of the switch assembly shown in FIGS. 1 through 3.

However, it is to be distinctly understood that the drawing illustrations referred to are provided primarily to comply with the disclosure requirements of the Patent Laws, and that the invention is susceptible of modifications and variations that will be obvious to those skilled in the art, and that are intended to be covered by the appended claims.

GENERAL DESCRIPTION

The basic objective of the present invention is to provide a hermetically sealed snap switch arrangement 10 that is to be used as part of a complete control system, as indicated, for indicating, for instance, pressure, fluid flow and/or level, bulk solid level, proximity, valve position, etc. While the hermetically sealed switch arrangement 10 is of wide applicability in connection with such control systems, the incorporation of the hermetically sealed snap switch arrangement 10 in control systems used in explosive, corrosive, dusty, and damp environments, enhances the performance of such controls.

Referring now more specifically to the drawings, reference numeral 10 generally indicates the hermetically sealed switch arrangement of the present invention, which comprises hermetically sealed housing 11 defined by outer housing member 12 and an inner housing member 14, with the housing members 12 and 14, as assembled, defining hermetically sealed switch chamber 16 in which a conventional snap switch 18 provided with an actuating member 20 (see FIGS. 5–7) is operably mounted, without requiting the usual mounting bracket for the switch 18.

The Applicant's hermetically sealed snap switch arrangement 10 that is illustrated in the drawings represents a preferred embodiment of the invention, although it will be apparent that some features of the preferred embodiment that are hereinafter disclosed may be varied at the option of those skilled in the art.

In accordance with the Applicant's invention, the switch 18 is of the subminiature snap action switch type having projecting pin type terminals 22, 24, 26 (see FIGS. 5–7) that are available in conventional snap switches of this general type that are offered by a number of U.S. companies, such as the Micro-Switch Division of Honeywell, Inc., Freeport, Ill. Hermetically seal mounted in inner housing member 14 and disposed to project outwardly of switch chamber 16 are a similar number of open ended tubes 28, 30, and 32 that are oriented and proportioned for slip fit receiving, respectively, the respective pin type terminals 22, 24, 26 of the switch 18, and mounting the switch 18 within the chamber 16, in the manner indicated in FIGS. 5–7, free of any mounting bracket. Further, the housing members 12 and 14 are connected together in such a manner that the chamber 16 is hermetically sealed thereabout at their abutting portions indicated in FIGS. 5–7, with the switch actuating member 20 being activated by an external lever 34 that actuates internal lever 36 through a housing hermetic wall portion 38 (see FIGS. 5–7) to which both levers 34 and 36 are suitably bonded or fixed; the respective switch terminals 22, 24, and 26 are respectively hermetically sealed with respect to the respective housing tubes 28, 30 and 32 (in which they are respectively mounted), and lead wires 40, 42, and 44 are electrically connected, in a hermetically sealed fashion, to the respective housing tubes 28, 30, and 32, with the remaining space that is defined by the housing 11 exterior of inner housing member 14 being filled with a suitable potting material 48 that overlies the electrical connections of the respective lead wires 40, 42, and 44, to the respective tubes 28, 30, and 32, and thus hermetically seals such connections.

SPECIFIC DESCRIPTION

The outer housing member 12 comprises a cover 50 that is of rectangular dished or cupped shape configuration that is suitably formed from a suitable grade of steel in imperforate sheet metal form to define base wall 52 that is integral with encompassing side wall 54 that extends from the base wall 52 to the side wall marginal rim portion 56 that is encompassing relation with respect to the housing 11. The base wall 52 of the outer housing member 12 is essentially planar in configuration, except where it is formed to define the indentation or dimple 58, which defines the housing hermetic wall portion 38 that essentially parallels the outer housing member base portion 52, and that is circumscribed by annular base wall segment 59.

Associated with the outer housing member 12 is external lever 34 that at its distal end 60 has suitably affixed thereto a contact 62 (see FIGS. 5–7) which is spot welded or otherwise suitably affixed to the exterior of outer housing member hermetic wall portion 38, with the lever 34 also defining proximal end 64 that, in accordance with the present invention, effects activation of switch 18. For this purpose, inner lever 36 is provided having distal end 66 integral with contact 68 that is also suitably fixed to the interior of the hermetic wall portion 38 of the outer housing member 12; the proximal end 70 of the internal lever 36 operably engages the actuating member 20 of the switch 18 (see FIGS. 5–7).

Levers 34 and 36 are suitably formed from strips of relatively stiff metallic material, since their function is to transmit without substantial deflection downward thrust that is applied to the distal end 64 of external lever 34 to physically move the proximal end 70 of internal lever 36, by way of both levers 34 and 36 being affixed to the hermetic wall portion 8 of housing member 12 that flexes independently of base wall 52 for this purpose, whereby the internal lever 36 is activated to depress switch actuation member 20 and thereby actuate the switch 18 in accordance with the specific arrangement of this snap switch and the manner in which the installer has installed assembly 10 in the control system of which the assembly 10 is made a part. For this purpose, levers 34 and 36 are preferably disposed in substantial parallelism.

The switch 18 may be in the form of any suitable conventional subminiature snap action switch of the type indicated, which is provided with conventional pin type terminals 22, 24, and 26.

The outer housing member 12 also includes a pair of spaced mounting tubes 72 and 74 (see FIGS. 5–7) that are open ended, extend transversely or crosswise of the housing member 12, and have their respective ends (73, 75, 77, and 79) welded to and about corresponding apertures 78, 80, 82, and 84 that are formed in the side wall 54 of the outer housing member 12 in any suitable manner to effect a hermetic seal at these corresponding locations of the assembly 10. The cross tubes 72 and 74 are for the purpose of suitably mounting the hermetically sealed snap switch arrangement 10 by passing suitable mounting screws (not shown) through the open bores of these tubes and fixed structure aperturing that suitably mounts assembly 10 for operation purposes when it is installed (it is assumed, of course, that suitable nuts or the like are applied to such screws to hold the assembly 10 involved in place).

Figure 5:
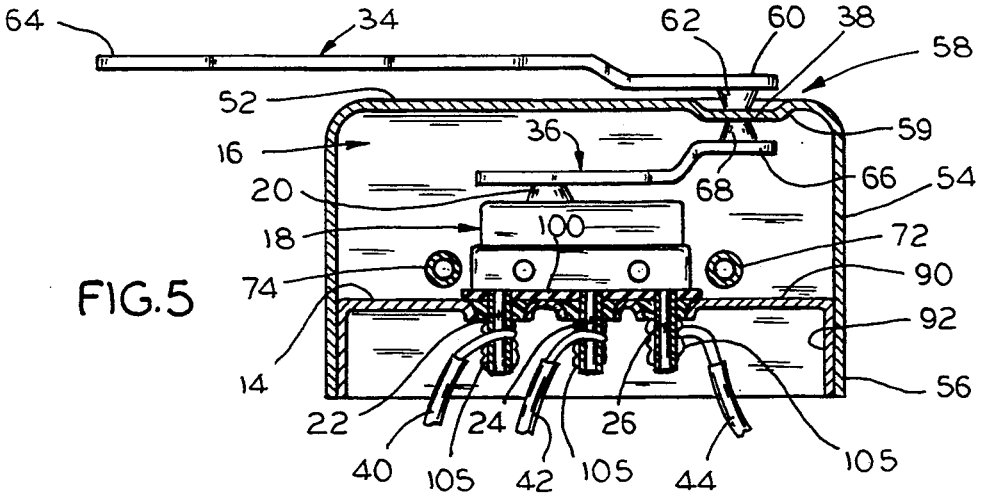
FIG. 5 is a sectional view through the switch assembly, shown along line 5—5 of FIG. 4, with the potting material shown in FIG. 3 omitted.
Figure 6:
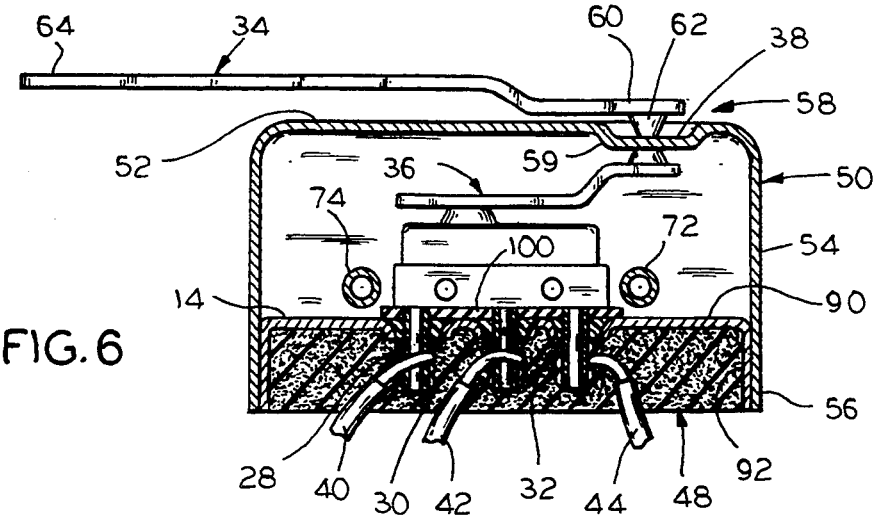
FIG. 6 is a view similar to FIG. 5, but with such potting material included.
Figure 7:
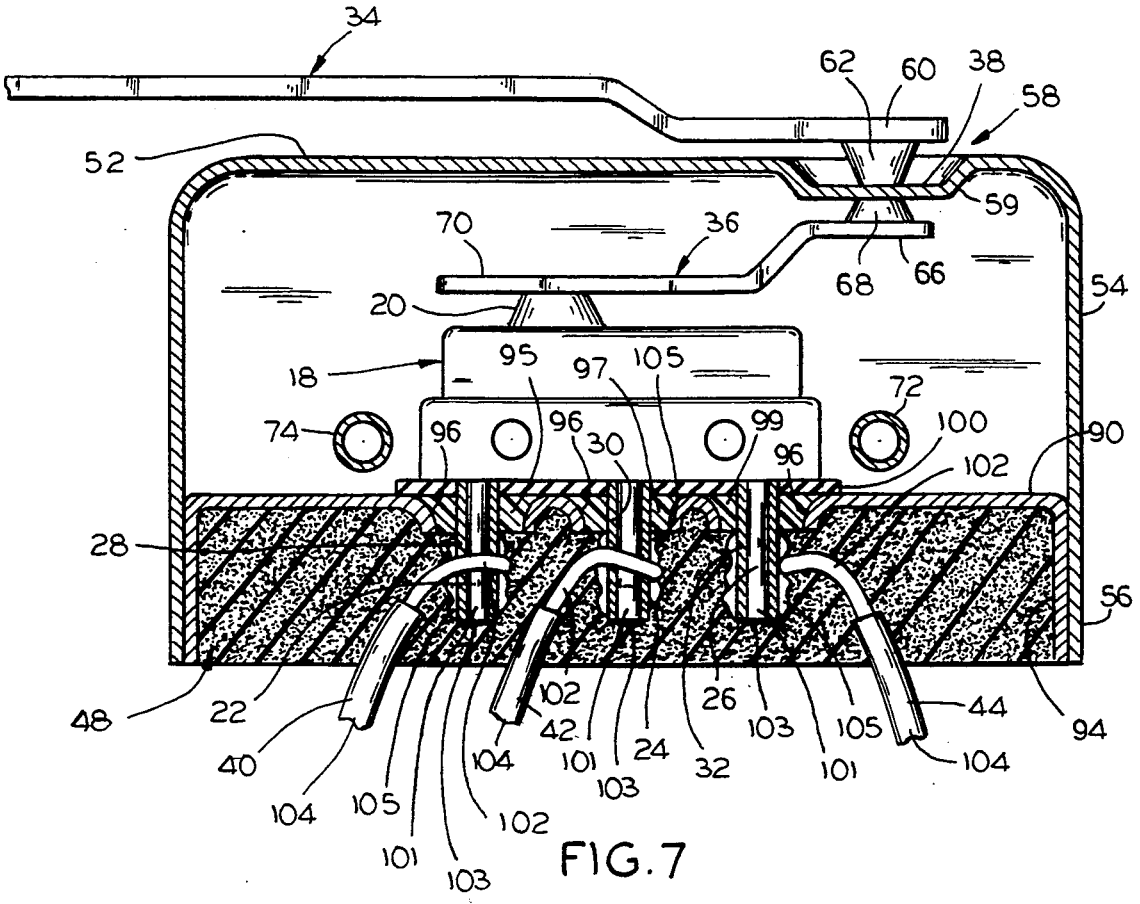
FIG. 7 is a larger scale view of FIG. 6.

The inner housing member 14 is also of imperforate sheet metal form, as indicated by drawing FIGS. 3 and 5–7, that defines a rectangular dished or cupped configuration and is proportioned to frictionally slip inside the marginal rim portion 56 defined by the outer housing member 12. The inner housing member 14 defines base wall 90 (see FIGS. 5–7) that is integral with side wall 92 thereabout, which extends between the indicated base wall 0 and the marginal rim 94 of the inner housing member side wall 92. The base wall 90 of the inner housing member is formed with a number of eyelets 96 (see FIG. 7) in spaced apart relation that, in accordance with the present invention, are numerically the same as the number of pin type terminals that the switch 18 is to have, with the respective tubes 28, 30, and 32 being hermetically sealed to such eyelets 96, respectively, with the respective glass seals 95, 97, and 99 (see FIG. 7, that may be formed of any suitable type of glass material that is arranged for hermetic sealing purposes); the respective tubes 28, 30, and 32 are located relative to the inner housing member 14 to smoothly accept the respective switch terminals 22, 24, and 26 respectively; a suitable layer or sheet of insulating (electrically) material 100 preferably separates switch 18 from the inner housing member base wall 90, which layer 100 may be formed from commercially available RTV rubber and was found by Applicant to permit adequate purging of switch chamber 16 (as hereinafter specifically described) due apparently to the voidage present between the switch 18 and layer 100 in successful tests run by Applicant; alternately, layer 100 may take the form of what is known commercially as "glass cloth", which is commonly available porous material that consists of a fiberglass filament fabric that is coated with a flexible varnish (an example of which is the flexible varnished "glass cloth" product offered by the Industrial Plastics Division of Westinghouse Electric Corporation). It is, of course, preferable that the layer 100 be apertured in accordance with the orientation of the respective switch terminals 22, 24, and 26 since such switch terminals extend from the switch 18 well into the respective tubes 28, 30, and 32, as indicated in FIGS. 5–7. Further, the externally disposed ends 101 of the respective terminals 22, 24, and 26 are respectively soldered to and about the respective tubes 28, 30, and 32, that they are received in (as at 103) to hermetically seal the respective tubes 28, 30, and 32.

While the respective tubes 28, 30, and 32 receive, respectively, the respective pin type terminals 22, 24, and 26 of the switch 18 to mount switch 18 within chamber 16, optionally, any one of such tubes 28, 30, or 32 may thereafter be employed to purge chamber 16 and then backfill same with a gas, to enhance the electrical life of the subminiature switch 18, as hereinafter disclosed, after which said sealing of such tube is effected.

For purposes of "wiring" switch 18, the respective lead wires 40, 42, and 44 each comprise the usual metallic, electrically conducting, core 102 within the usual insulative coveting 104; in accordance with the present invention, the cores 102 of the respective lead wires 40, 42 and 44 are operably connected to the respective switch pin type terminals 22, 24, and 26 by being connected to their respective tubes 28, 30, and 32 in some manner. As shown in FIGS. 5 though 7, this may be done by wrapping the respective lead wire cores 102 around the respective tubes 28, 30 and 32 and spot welding or soldering them in place (as at 105), or by employing a suitable conventional mechanical device for connecting the respective lead wire cores to the respective tubes, which may be of the so-called "quick-connect" or "stake-on" type, for instance. The remaining volumes of the space surrounding the electrical connections of the lead wires 40, 42 and 44 to the respective tubes 28, 30, and 32 is filled with a suitable potting compound 48 which preferably overlies the electrical connections of the respective lead wires 40, 42, and 44 to the respective tubes 28, 30, and 32, and the hermetic sealing 103 of the respective tubes 28, 30 and 32 to the respective switch terminals, down to and including the terminal portions of the respective lead wire covers 104. A potting material preferred for this purpose is the EL-CAST Resin 4123 hardener that is available from United Resin Corporation, of Santa Ana, Calif.

As indicated, the inner housing member 14 is proportioned for slip fit application within the side wall 54 of the outer housing member 12, as indicated in FIGS. 5 though 7, and with the switch 18 and lead wires 40, 42, and 44, applied to the inner housing member 14 as indicated, the inner housing member 14 is slipped within the rim 56 of side wall 54 of the outer housing member, and the joint between the inner housing members 12 and 14 is suitably hermetically sealed, as by welding same continuously about the margin 56 (prior to the application of the potting material 48 to the inner housing member 14) or in any other suitable manner.

The resulting hermetically sealed snap switch arrangement 10 is adapted for retrofitting into controls which utilize the Basic Series Switch (which is an industry standard).

When a suitable sensing mechanism through a suitable transmitter means (not shown) deflects the proximal end 64 of the external lever 34 of FIG. 1 through 7 of the drawings, counter clockwise of FIGS. 5–7, lever 34 moves as a whole in the same direction, with its contact 62 at its distal end 60 similarly flexing hermetic wall portion 38 in the same direction, thereby effecting movement of the internal lever 36 as a whole in the same direction.

Since the contact 68 at the distal end of lever 36 is affixed to hermetic wall portion 38, movement of internal lever 36 is in the same direction as that experienced by external lever 34, whereby internal lever 36 actuates switch 18 in accordance with the options worked into the control system by the installer.

The biasing action of the switch 18 on its actuator 20 effects repositioning of the levers 36 and 34 to their original positions of drawing FIGS. 1–7.

It will be apparent to those skilled in the art that the hermetically sealed switch arrangement 10 also works in a reverse manner so as to actuate a suitable switch (not shown) with which external lever 34, and specifically its proximal end 64, is associated, provided, of course, that the conventional switch that is used for this purpose (in place of switch 18) is suitably arranged to this end.

The present invention also contemplates, as indicated, that after assembly in the manner indicated, the switch chamber 16 may be purged and then backfilled with a gas, such as hydrogen, nitrogen, or helium, to enhance the electrical life of the subminiature snap switch 18 employed in connection with this invention. For this purpose, one of the tubes 28, 30, or 32 is initially left free of hermetic sealing 103 with respect to the switch terminal received therein, and before the potting material 48 is applied to the assembly 10, one end of a suitable flexible conduit (not shown) is applied to the exteriorly projecting end of the unsealed tube, and a suitable reversible gas pump or the like is applied to the other end of the conduit to first purge the chamber 16 of air and other gas remaining in same, and then reversing the pump involved, supplying a gas (such as the aforementioned hydrogen, nitrogen, or helium) to the chamber 16 as desired. Thereafter, the indicated flexible conduit is removed from the indicated tube of the assembly 10, after which such tube of assembly 10 is hermetically sealed with respect to the switch terminal received therein, after which the potting material 48 is applied to complete the device 10 as indicated.

A major improvement provided by the present invention is the hermetic sealing of the assembly tubes 28, 30, and 32 by applying the glass sealing arrangement thereto that is described and illustrated. Another important improvement is the presence of the tubes 28, 30, and 32 themselves, which, as a whole, not only act as a socket that accepts the pin type terminals of subminiature snap action switches such as a switch 18, but also provide the option that any one of such tubes may be employed for switch chamber purging and backfilling purposes. Further, the mounting arrangement for the subminiature snap action switch 18 eliminates the need for mounting brackets for same.

The foregoing description and the drawings are given merely to explain and illustrate the invention, and the invention is not to be limited thereto, except insofar as the appended claims are so limited, since those skilled in the art who have this disclosure before them will be able to make modifications and variations therein without departing from the scope of the invention.

I claim:

1. A hermetically sealed snap switch assembly comprising:

a housing defined by first and second housing members, said housing members each defining a substantially planar base wall, said first housing member being formed from imperforate material, said second housing member being mounted within said first housing member in hermetically sealed relation therewith, and with said base walls of said housing members being disposed in substantial parallelism to form said housing and define a switch chamber between said base walls of said housing members, said housing second member base wall including a plurality of depending electrically conductive tubes fixed to same in hermetically sealed relation therewith, said housing second member otherwise being formed from imperforate material, a snap action switch mounted in said switch chamber between said base walls of said housing members, said switch having a side that faces said first housing member base wall and is disposed within said chamber, said switch including an actuating member for said switch on said switch side and within said chamber, said switch being supported within said chamber by said second housing member base wall, said tubes each being disposed relative to said housing such that one end of each of said tubes projects away from said chamber, said switch having a plurality of terminals depending therefrom and that are individually lodged within said tubes, respectively, in slip fit relation thereto, said base wall of said first housing member having a portion of same indented out of the plane thereof to form a hermetic wall portion, a first lever disposed externally of said housing, said first lever extending in general parallelism to said switch side and being fixed to said hermetic wall portion, a second lever disposed internally of said chamber and being fixed to said hermetic wall portion and engaging said actuating member of said switch, and including means for fixing the respective tubes to the switch terminals lodged therein and in hermetically sealed relation thereto, whereby said tubes provide the option of purging said chamber and backfilling same through one of said tubes prior to the application of said fixing means to said one of said tubes, and including:

an electrically insulating layer interposed between said switch and said second housing member base wall.

2. The switch assembly set for in claim 1, including:

lead wires respectively electrically connected to the respective said tubes, and, a potting material overlying both said lead wire connections to said tubes and said ends of said tubes.

3. The switch assembly set forth in claim 1, including:

lead wires respectively electrically connected to the respective tubes, with a potting material overlying said lead wire connections to the tubes, respectively, and substantially filling the space defined by said second housing member base wall and side wall.

4. The switch assembly set forth in claim 1, wherein:

said tubes are each disposed in an eyelet in said housing member base wall, with said tubes being respectively fixed to said housing second member base wall by glass seals that form said hermetically sealed relation therewith.

* * * * *